US005641394A

United States Patent [19]

Fisher et al.

[11] Patent Number: 5,641,394

[45] Date of Patent: Jun. 24, 1997

[54] STABILIZATION OF HYDROCARBON FLUIDS USING METAL DEACTIVATORS

[75] Inventors: Sherri L. Fisher, Sugar Land; Joseph P. Street, Friendswood, both of Tex.

[73] Assignee: Nalco/Exxon Energy Chemicals, L.P., Sugarland, Tex.

[21] Appl. No.: 417,559

[22] Filed: Apr. 6, 1995

[51] Int. Cl.[6] ..... C10G 9/16

[52] U.S. Cl. ..... 208/48 AA; 208/177; 208/290; 208/291

[58] Field of Search ..... 208/48 AA, 177, 208/290, 291; 585/864; 252/184

[56] References Cited

U.S. PATENT DOCUMENTS

| | | | |
|---|---|---|---|
| 2,353,192 | 7/1944 | Sargent et al. | 44/62 |
| 3,034,876 | 5/1962 | Gee et al. | 44/62 |
| 3,068,083 | 12/1962 | Gee et al. | 44/70 |
| 3,235,484 | 2/1966 | Colfer | 208/48 |
| 3,355,270 | 11/1967 | Amick et al. | 44/48 |
| 3,368,972 | 2/1968 | Otto | 252/47.5 |
| 3,437,583 | 4/1969 | Gonzalez | 208/48 |
| 3,442,791 | 5/1969 | Gonzalez | 208/48 |
| 4,032,304 | 6/1977 | Dorer et al. | 44/70 |
| 4,166,726 | 9/1979 | Harle | 44/73 |
| 4,200,545 | 4/1980 | Clason et al. | 252/33.4 |
| 4,847,415 | 7/1989 | Roling et al. | 564/367 |
| 4,883,580 | 11/1989 | Roling et al. | 208/48 AA |
| 4,894,139 | 1/1990 | Roling et al. | 208/48 AA |
| 5,271,863 | 12/1993 | Roling | 252/184 |

OTHER PUBLICATIONS

Inhibition of Deterioration of Cracked Gasoline During Storage, C.J. Pedersen, Industrial and Engineering Chemistry, vol. 41, No. 5, pp. 924–928.

*Primary Examiner*—Glenn A. Caldarola
*Assistant Examiner*—Thuan D. Dang
*Attorney, Agent, or Firm*—James J. Drake; Robert A. Miller

[57] ABSTRACT

The invention is a composition for use in deactivating iron species in hydrocarbon fluids, comprising the products resulting from the reaction of (I), with (II) and (III) is disclosed; wherein (I) is a substituted catechol of the structure where R is chosen from alkyl, aryl, alkaryl, or arylalkyl from about 1 to 20 carbon atoms; wherein (II) is a mixture of polyamines having the repeat structure (II)

wherein m ranges from 1 to 10 and where X is an alkyl, branched alkyl, cyclic or branched cyclic alkyl of from 1 to 10 carbon atoms, and where Y is a substituted alkylphenol of structure where R" is chosen from alkyl, aryl, alkaryl, arylalkyl of from about 1 to 22 carbon atoms; wherein (III) is an aldehyde of structure (III)

where R' is chosen from hydrogen, and an alkyl of from 1 to 6 carbon atoms. Also disclosed is the function of the said same composition, resulting from the reaction of (I) with (II) and (III), as an antioxidant in hydrocarbon fluids. The antioxidant function is separate from, and in addition to the metal deactivating properties of the invention. These functional properties of the invention can act either singly, or in concert, for the stabilization of hydrocarbon fluids. Further a method of deactivating iron species in hydrocarbon fluids using the described compound is disclosed.

7 Claims, 1 Drawing Sheet

STABILIZATION OF HYDROCARBON FLUIDS USING METAL DEACTIVATORS

BACKGROUND OF THE INVENTION

1. Field of the Invention

This invention relates to the use of chelating molecules to deactivate iron and other transition metal species to prevent fouling in hydrocarbon fluids. Specifically, the invention relates to the use of Mannich reaction products of catechols with various polyamines as deactivating compounds.

2. Description of the Prior Art

In a hydrocarbon stream, saturated and unsaturated organic molecules, oxygen, peroxides, and metal compounds are found. Transition metal compounds such as iron can initiate fouling in three ways. First, they can interact with peroxides by catalyzing free radical formation and subsequent fouling. Second, metal species can complex oxygen and catalyze the formation of peroxides. Last, metal compounds can react directly with organic molecules to yield free radicals.

The first row transition metal species manganese, iron, cobalt, nickel, and copper are found in trace quantities (0.01 to 100 ppm) in crude oils. These metal species are carried over to hydrocarbon streams that are being refined, and in refined products with additional ions. C. J. Pedersen (Inc. Eng. Chem., 41,924–928, 1949) showed that these transition metal species reduce the induction time for gasoline, and indication of free radical initiation. Iron compounds are more likely to initiate free radicals than the other first row transition elements under these conditions.

To counteract the free radical initiating tendencies of the transition metal species and, in particular, iron, so called metal deactivators are added to hydrocarbons with transition metal species already in the hydrocarbon. These materials typically are organic chelators which tie up the orbitals on the metal rendering the metal inactive. When metal species are deactivated, fewer free radicals are initiated and smaller amounts of antioxidants are required to inhibit polymerization. However, not all chelators will function as metal deactivators. In fact, some chelators will act as metal activators. Pedersen showed that while copper is deactivated by many chelators, other transition metals are only deactivated by selected chelators.

Schiff Bases such as N,N'-salicylidene-1,2-diaminopropane are the most commonly used metal de, activators. In U.S. Pat. Nos. 3,034,876 and 3,068,083, the use of this Schiff Base with esters were claimed as synergistic blends for the thermal stabilization of jet fuels. Gonzalez, in U.S. Pat. Nos. 3,437,583 and 3,442,791, claims the use of N,N'-disalicylidene-1,2-diaminopropane in combination with the product from the reaction of a phenol, an amine, and an aldehyde as a synergistic antifoulant. Alone the product of reaction of the phenol, mine, and aldehyde had little, if any, antifoulant activity.

Products from the reaction of a phenol, an mine, and an aldehyde (known as Mannich-type products) have been prepared in many ways with differing results due to the method of preparation and due to the exact ratio of reactants and the structure of the reactants.

Metal chelators were prepared by a Mannich reaction in U.S. Pat. No. 3,355,270. Such chelators were reacted with iron to form a metallic chelate complex which metallic complex was then added to the furnace oil as a catalyst to enhance combustion. The activity of the iron was not decreased or deactivated by the hyphenate chelator.

Sargent et at. U.S. Pat. No. 2,353,192, and Otto, U.S. Pat. No. 3,368,972, teach that Mannich products can be prepared from alkyl substituted catechols. However, such products are not actually prepared. The alkylphenol Mannich products that are prepared in these two patents are used in finished products, where detectable amounts of transition metals are initially absent, as stabilizers against oxidation.

Mannich-type products were used as dispersants in U.S. Pat. No. 3,235,484, U.S. Pat. No. Re. 26,330, U.S. Pat. Nos. 4,032,304 and 4,200,545. A Mannich-type product in combination with a polyalkylene amine was used to provide stability in preventing thermal degradation of fuels in U.S. Pat. No. 4,166,726.

Copper, but not iron, is effectively deactivated by metal chelators such as N,N'-disalicylidene-1,2-diaminopropane. Mannich-type products, while acting as chelators for the preparation of catalysts or as dispersants, have been shown to be iron ion deactivators in U.S. Pat. Nos. 5,271,863, 4,883,580 and 4,847,415.

SUMMARY OF THE INVENTION

The invention is a composition for use in deactivating iron species in hydrocarbon fluids, comprising the products resulting from the reaction of (I), with (II) and (III) is disclosed; wherein (I) is a substituted catechol of the structure

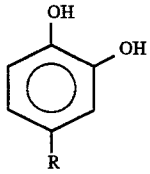

(I)

where R is chosen from alkyl, aryl, alkaryl, or arylalkyl from about 1 to 20 carbon atom; wherein (II) is a mixture of polyamines having the repeat structure

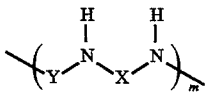

(II)

wherein m ranges from 1 to 10 and where X is an alkyl, branched alkyl, cyclic or branched cyclic alkyl of from 1 to 10 carbon atoms, and where Y is a substituted alkylphenol of structure

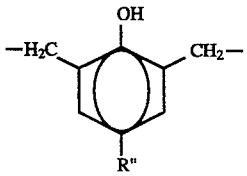

where R" is chosen from alkyl, aryl, alkaryl, arylalkyl of from about 1 to 22 carbon atoms; wherein (III) is an aldehyde of structure

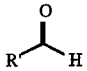

(III)

where R' is chosen from hydrogen, and an alkyl of from 1 to 6 carbon atoms. Also disclosed is the function of the said same composition, resulting from the reaction of (I) with (II) and (III), as an antioxidant in hydrocarbon fluids. The antioxidant function is separate from, and in addition to the metal deactivating properties of the invention. These functional properties of the invention can act either singly, or in concert, for the stabilization of hydrocarbon fluids.

Further a method of deactivating iron species in hydrocarbon fluids using the described compound is disclosed.

DESCRIPTION OF THE PREFERRED EMBODIMENTS

Figure 1:
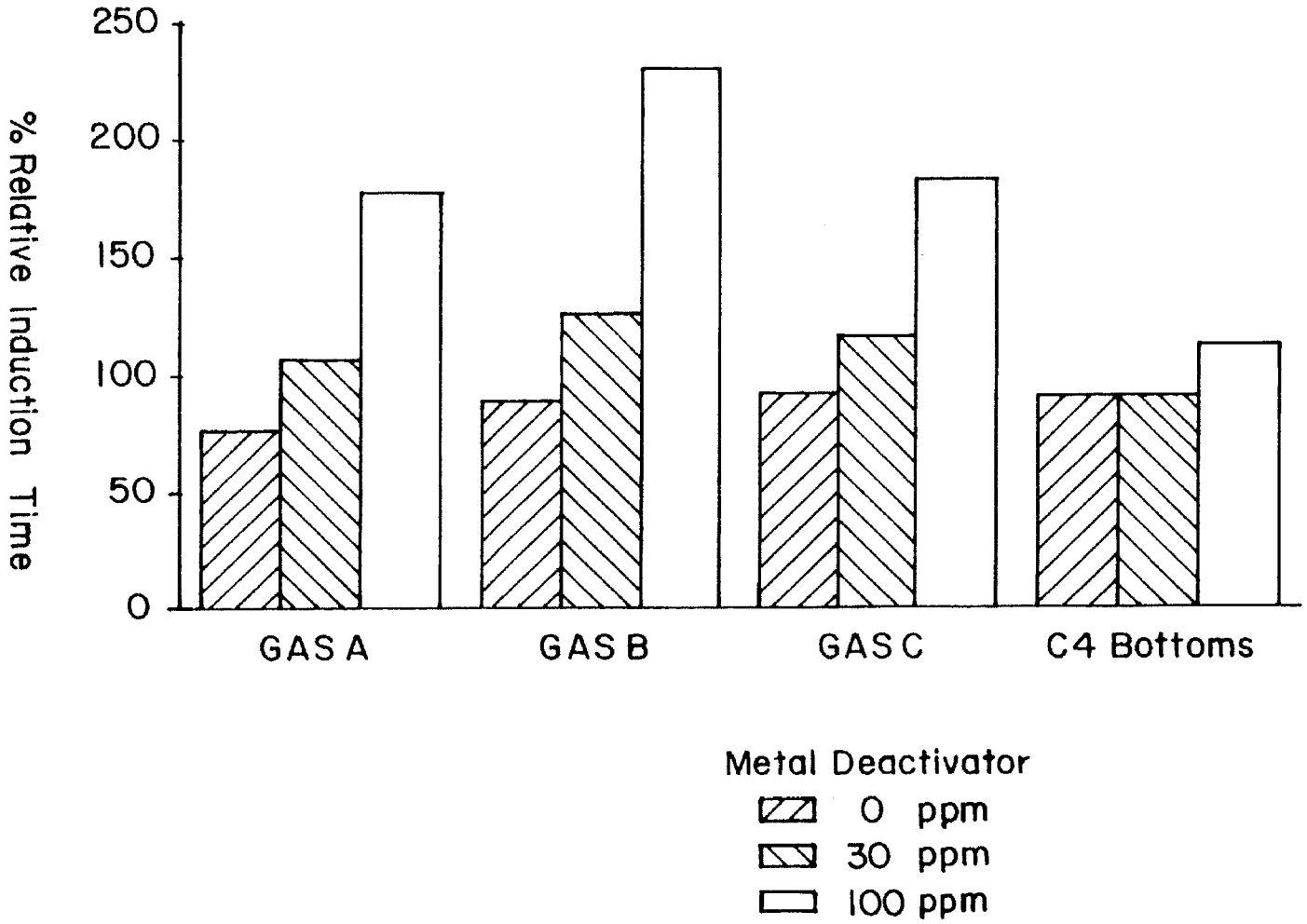
FIG. 1 shows ASTM D-525 oxygen uptake tests on fuel streams

A composition for use in deactivation iron and other transition metal species in hydrocarbon fluids having the composition resulting from the reaction of (I) with (II) and (III) as described above. Especially preferred is the composition resulting from the products of the reaction of (I) with (II) and (III) as described above where R is a tertiary butyl, X is ethylene, R" is dodecyl, and R' is hydrogen. Further, a method of deactivation metal ion species, especially iron species in hydrocarbon fluids using the described compound is disclosed. The method comprises the steps of providing the deactivating composition resulting from the reaction of (I) with (II) and (III) as described above, and adding said composition to a hydrocarbon fluid. In the preferred method, the amount of said composition added is from abut 1 to about 200 parts per million. More preferably, the mount of said composition added is from about 2 to about 75 parts per million. In the most preferred method the amount of said composition added is from about 5 to about 25 parts per million. The deactivating composition is added by direct injection into the process flow. The method may be used to treat any hydrocarbon fluid but is preferably used in conjunction with styrene, ethylene, butadiene, and vinyl chloride process streams, as well as straight run gasoline and cracked gasoline stocks such as CAT naphtha from a FCC unit.

The following examples are represented to describe preferred embodiments and utilities of the invention and are not meant to limit the invention unless otherwise stated in the claims appended hereto.

EXAMPLE 1

The efficacy of the Mannich product described above was tested by using a peroxide test. The peroxide test is commonly used to measure the metal deactivating ability of a compound.

To a 250 ml 3 necked RB flask was added 10 ml of a 0.01M iron naphthenate solution n in xylene and 10 ml of 3% $H_2O_2$ solution. A pressure equalized adding funnel is charged with 25 ml of 6% $NH_4OH$ is attached to the flask. A gas outlet lube is attached to the flask and the flask securely sealed. The gas tube is placed under a 100 ml graduated cylinder that is filled with water. The solution is vigorously stirred and the $NH_4OH$ is added all at once. A stop watch is started when adding starts. The volume of gas evolved (ml $H_2O$ displaced) is recorded every 30 seconds for 5 minutes. After an initial 6–10 ml of gas evolution due to thermal expansion of the flask contents, $O_2$ evolution from the catalytic activity of the metal ions is measured.

TABLE I

| | MDA PEROXIDE TEST BLANK | | |
|---|---|---|---|
| MINUTES | RUN #1 ml $O_2$ | RUN #2 ml $O_2$ | Run #3 ML $O_2$ |
| 0.5 | 6 | 11 | 11.5 |
| 1.0 | 11 | 16 | 15 |
| 1.5 | 15 | 17 | 18 |
| 2.0 | 17 | 18 | 20 |
| 2.5 | 18.5 | 20 | 21 |
| 3.0 | 21 | 22 | 23 |
| 3.5 | 25 | 25 | 25 |
| 4.0 | 27 | 27 | 26 |
| 4.5 | 29 | 30 | 27 |
| 5.0 | 30 | 32 | 30 |

TABLE II

| MDA PEROXIDE TEST CATECHOL | |
|---|---|
| Minutes | ml $O_2$ |
| 0.5 | 8 |
| 1.0 | 8 |
| 1.5 | 8 |
| 2.0 | 8 |
| 2.5 | 8 |
| 3.0 | 8 |
| 3.5 | 8 |
| 4.0 | 8 |
| 4.5 | 8 |
| 5.0 | 8 |

CATECHOL: 10% in toluene

EXAMPLE 2

The efficacy of the above described catechol was further tested using a oxygen uptake test, ASTM D-525, which is also an accepted test in the industry for measuring the metal deactivator and antioxidant activity. FIG. 1 shows ASTM D-525 oxygen uptake tests on fuel streams containing 1 ppm added iron naphthenate. Induction time results are given as a percentage of the blank fuel induction times without added metal ion. Gas A, B and C, are FCCU light CAT naphtha streams. The C4 bottoms is comprised of olefin plant debutanizer bottoms.

Changes can be made in the composition, operation and arrangement of the method of the present invention described herein without departing from the concept and scope of the invention as defined in the following claims:

We claim:

1. A method for deactivating iron in hydrocarbon fluids, the method comprising adding a deactivating amount of a metal deactivating compound to a hydrocarbon fluid, the compound comprising the reaction product of:

a substituted catechol of the structure;

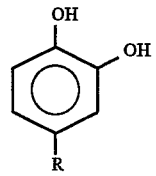

(I)

wherein R is chosen from alkyl, aryl, alkaryl, or arylalkyl from about 1 to 20 carbon atoms;

a mixture of polyamines having the repeat structure

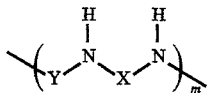

(II)

wherein m ranges from 1 to 10 and where X is an alkyl, branched alkyl, cyclic or branched cyclic alkyl of from 1 to 10 carbon atoms, and where Y is a substituted alkylphenol of structure

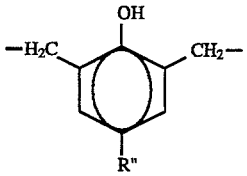

where R" is chosen from alkyl, aryl, alkaryl, arylalkyl of from about 1 to 22 carbon atoms; and an aldehyde of structure

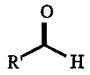

(III)

2. The method of claim 1, wherein R is tertiary butyl, X is ethylene, R" is dodecyl and R' is hydrogen.

3. The method of claim 1, wherein the hydrocarbon fluid is selected from the group consisting of styrene, ethylene, butadiene, vinyl chloride process streams and cracked gasoline stocks.

4. The method of claim 1, wherein the amount of metal deactivating compound added is from about 1 to about 100 parts per million.

5. The method of claim 4, wherein the amount of metal deactivating compound added is from about 2 to about 75 part per million.

6. The method of claim 5, wherein the amount of metal deactivating compound added is from about 5 to about 25 parts per million.

7. The method of claim 1, wherein the metal deactivating compound is added by direct injection.

* * * * *